United States Patent [19]

Nishimoto

[11] 4,402,242

[45] Sep. 6, 1983

[54] ELECTRONIC MUSICAL INSTRUMENT BY TIME DIVISION MULTIPLEXED TONE SELECTION

[75] Inventor: Tetsuo Nishimoto, Hamamatsu, Japan

[73] Assignee: Nippon Gakki Seizo Kabushiki Kaisha, Hamamatsu, Japan

[21] Appl. No.: 228,402

[22] Filed: Jan. 26, 1981

Related U.S. Application Data

[63] Continuation of Ser. No. 964,932, Nov. 30, 1978.

[30] Foreign Application Priority Data

Dec. 15, 1977 [JP] Japan ..... 52-150895

[51] Int. Cl.[3] ..... G10H 1/00

[52] U.S. Cl. ..... 84/1.01; 84/1.03; 84/1.19; 84/1.24

[58] Field of Search ..... 84/1.01, 1.03, 1.24, 84/1.19

[56] References Cited

U.S. PATENT DOCUMENTS 3,889,951 8/1975 Griffith et al. ..... 84/1.01
4,012,982 3/1977 Southard ..... 84/1.01
4,114,497 9/1978 Hiyoshi et al. ..... 84/1.19
4,186,635 2/1980 Aoki et al. ..... 84/1.03

*Primary Examiner*—J. V. Truhe
*Assistant Examiner*—Forester W. Isen
*Attorney, Agent, or Firm*—Charles E. Pfund

[57] ABSTRACT

An electronic musical instrument comprises a plurality of key switches and a key switch scanning circuit for sequentially scanning said key switches at a predetermined speed to produce time division multiplexed key data signals representing the depressed states of respective keys. The instrument further comprises a time division multiplexed tone waveform generating circuit which generates tone signals on a time division basis and in synchronism with the scanning of said key switches, said tone signals consisting of waveform samples of all the notes, i.e. tone frequencies, that the instrument can generate, and means which delivers out the output signal from the time division multiplexed tone waveform generating circuit at the moments when said time division multiplexed key data signals arrive, thereby producing plurality of tone signals in a time division multiplexed manner.

7 Claims, 13 Drawing Figures

| | |
|---|---|
| FIG.2A<br>FIG.2D | FIG.2B |

ELECTRONIC MUSICAL INSTRUMENT BY TIME DIVISION MULTIPLEXED TONE SELECTION

This is a continuation of application Ser. No. 964,932 filed Nov. 30, 1978.

BACKGROUND OF THE INVENTION

This invention relates to electronic musical instruments and more particularly to electronic musical instruments by a time division multiplex tone selection mode.

In a prior art electronic musical instrument, tone generators are provided for respective keys (notes) for generating signals (tone signals) having frequencies defining the tone pitches of respective keys, whereby when a certain key is depressed, a tone signal corresponding to that key is produced. When there is any other key which is depressed concurrently with said key, a tone signal corresponding to the other key is also generated simultaneously. The tone signals thus produced are mixed together and then sent to a tone color circuit to be imparted with a definite tone color. As a result, tone signals are produced to sound musical tones corresponding to the depressed keys.

Although such a prior art electronic musical instrument can simultaneously generate a plurality of musical tones, it is necessary to provide a plurality of tone generators for generating tone signals of the same number as the keys. Accordingly, there is a defect that the number of the tone generators increases in proportion to the increase in the number of keys. Since the tone generator utilizes an analogue oscillator, it is difficult to construct the tone generator by integrated circuits, and since a number of frequency dividers are required, the size of the musical instrument would become large and the cost high.

Furthermore, in an electronic musical instrument, there is added a coupler effect device which simultaneously switches a plurality of tone signals having a predetermined relationship (for example an octave relationship) corresponding to a depressed key for providing a coupler effect. However, such a coupler effect device requires to provide a plurality of key switches or switching circuits for each key thus complicating the construction. Moreover, there is a problem that it is impossible to increase the number of the tone signals that can be simultaneously keyed by the coupler effect device.

Although an electronic musical instrument utilizing digital technique has recently been developed, in the electronic musical instrument of this type the number of musical tones that can be produced simultaneously is limited. For this reason, as the number of the simultaneously generated tones is increased, the circuit construction becomes complicated. Furthermore, in the electronic musical instrument of this type, in order to provide aforementioned coupler effect it is necessary to further increase the number of the simultaneously generated tones thus increasing the size of the electronic musical instrument.

SUMMARY OF THE INVENTION

It is, therefore, the primary object of this invention to provide an electronic musical instrument by a time division multiplexed tone selection mode capable of simultaneously producing a plurality of musical tones with a simple construction.

According to an embodiment of this invention, an electronic musical instrument comprising a plurality of key switches, a key switch scanning circuit for sequentially scanning said key switches at a predetermined speed to produce time division multiplexed key data signals representing the depressed states of respective keys, a time division multiplexed tone waveform generating circuit which generatoes tone signals on a time division basis and in synchronism with the scanning of said key switches, said tone signals consisting of waveform samples of all the notes, i.e. tone frequencies, that the instrument can generate, and means which delivers out the output signal of the time division multiplexed tone waveform generating circuit to at the moment when said time division multiplexed key data signals arrive, thereby producing plurality of tone signals in a time division multiplexed manner.

DISCRIPTION OF THE PREFERRED EMBODIMENT

Figure 1:
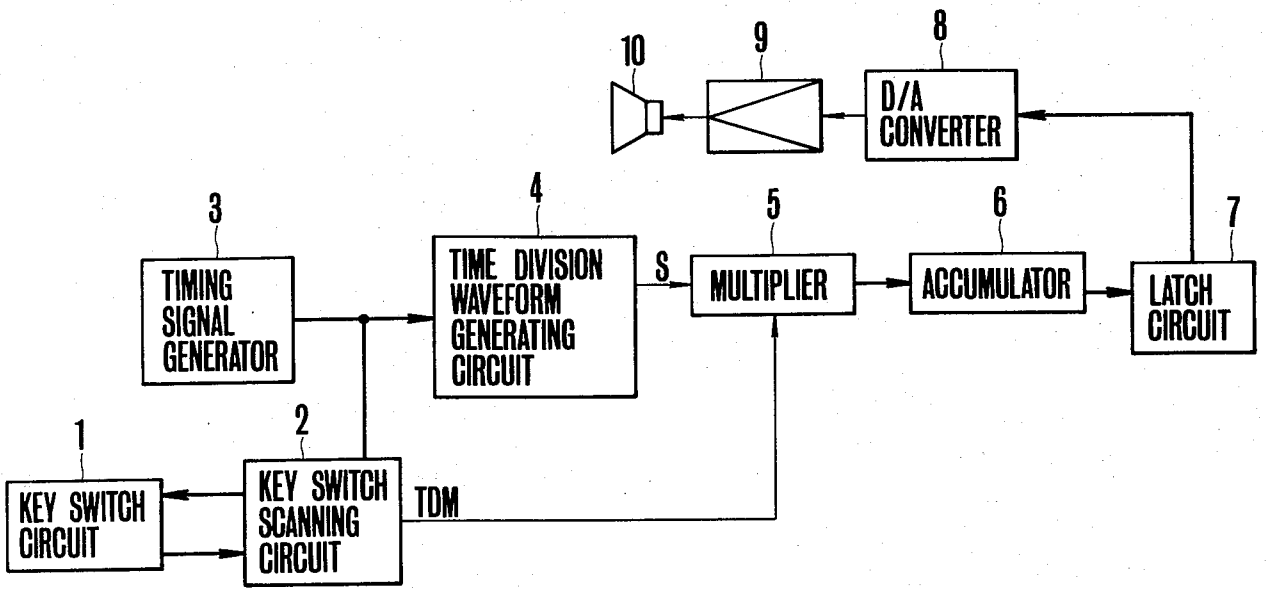
FIG. 1 is a block diagram showing the basic construction of an electronic musical instrument by a time division multiplexed tone selection mode according to this invention.

A preferred embodiment of this invention will now be described with reference to the accompanying drawings. FIGS. 1 to 4 illustrate one embodiment of the electronic musical instrument embodying the first invention of this application. Generally stated, the electronic musical instrument of this invention comprises a key switch circuit 1 including a plurality of key switches corresponding to respective keys on a keyboard (not shown) and arranged in a matrix, a key switch scanning circuit 2 which sequentially scans the key switches of the key switch circuit to produce a time division multiplex signal TDM representing the ON/-OFF states, that is the depressed states of respective key switches, a timing signal generator 3 which generates a timing signal that controls the operation of the key switch scanning circuit 2 and of a time division multiplexed tone waveform generating circuit 4 to be described later, a time division multiplexed tone waveform generating circuit 4 which generates a plurality of waveform signals (tone signals S) corresponding to the tone pitches of the respective keys on the time division basis and in synchronism with the scanning of said key switch circuit 1, a multiplier 5 which multiplies the output signal S of the time division waveform generating circuit 4 with said time division multiplex signal TDM, an accumulator 6 which is supplied with the output of the multiplier 5 for adding together the output signals in one scanning period of the key switch circuit 1 between the start and end of the scanning, a latch circuit 7 supplied with the count of the accumulator 6 at the end of each scanning period and latches the supplied count, a D/A converter 8 which converts the output signal (digital signal) of the latch circuit 7 into an analogue signal, an amplifier 9 which amplifies the output of the D/A converter 8, and a loudspeaker 10 which produces the output signal of the amplifier 9 as musical sound.

Figures 2A, 2D:
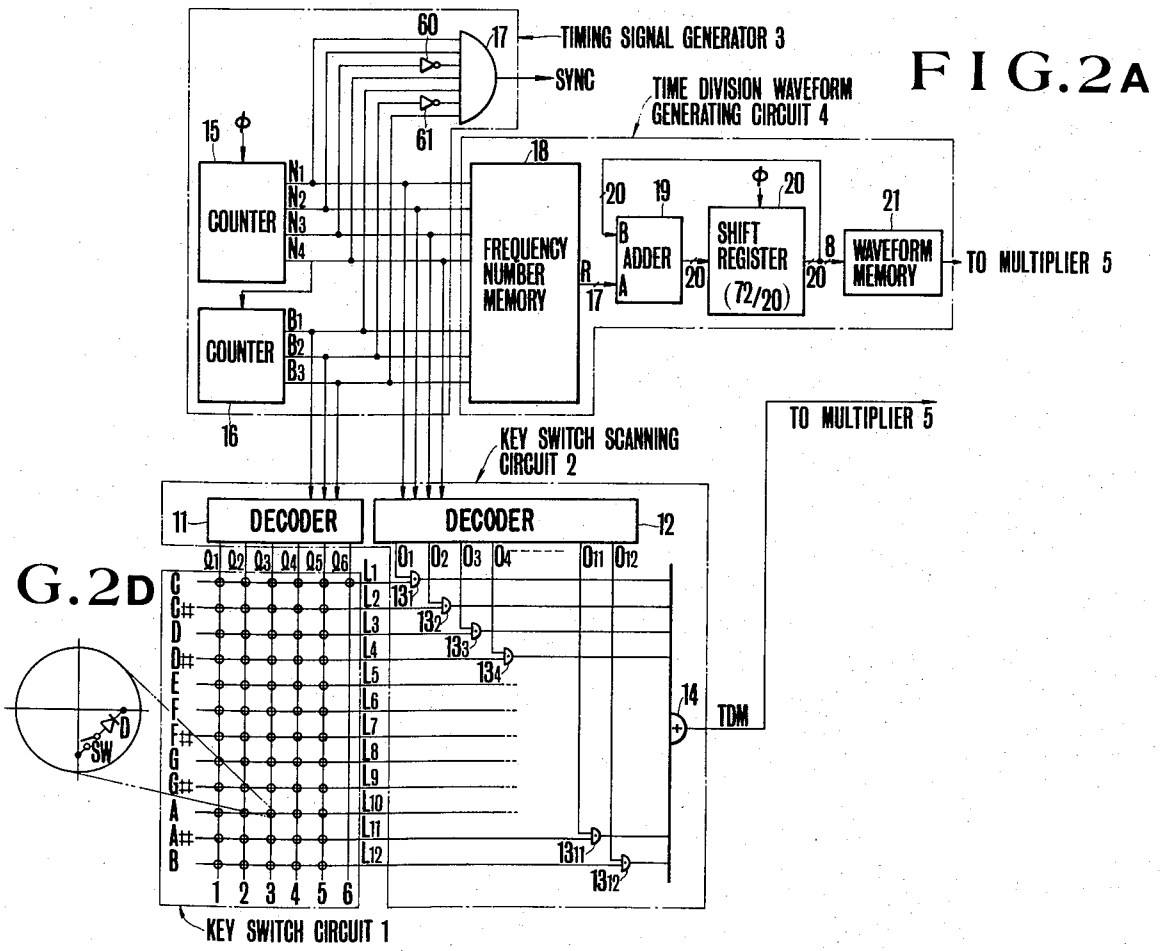
FIGS. 2A and 2B, when combined as shown in FIG. 2C, are a block diagram showing the essential part of FIG. 1 embodied.
FIG. 2D is an enlarged view of one of cross points in the key switch circuit as shown in FIG. 2.
Figures 2B, 2C:
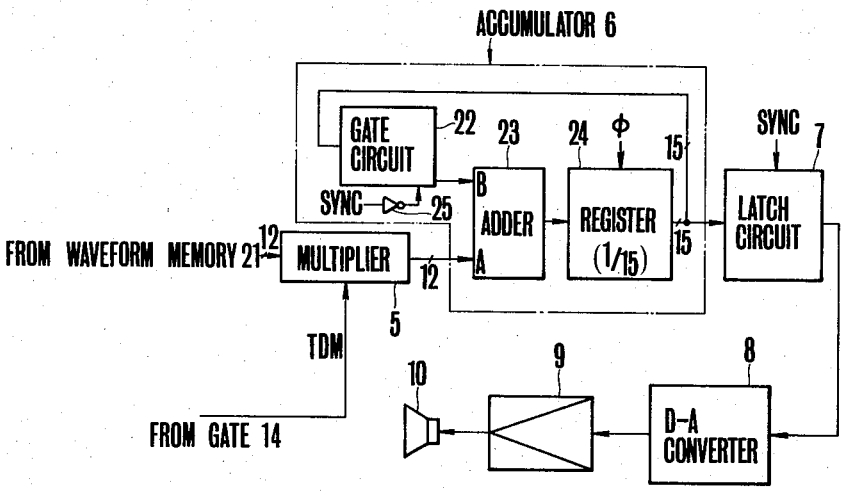

Each of the component elements 1 through 10 described above will now be described with reference to FIGS. 2 and 3. As is well known, one octave consists of 12 notes C, C#, D, . . . B. In this embodiment it is assumed that a total of 61 keys are provided on a keyboard (not shown) including 12 keys C2, C#2, D2, . . . B2 for the first octave, 12 keys C3, C#3, D3, . . . B3 for the second octave, 12 keys each for the third to fifth octaves designated in the same manner and one key C7 for the sixth octave. 61 key switches corresponding to the 61 keys are arranged in a matrix in the key switch circuit 1 as shown in FIG. 2A. More particularly, column lines l1—l6 of the key switch circuit 1 correspond to the first to sixth octaves whereas row lines L1-L12 correspond to respective octave notes C, C#, . . . B. For example, the key switch of the key E2 of the first octave is disposed at the cross point of the column lines l1 and row line L5. Circles at the cross-points of the column lines l1—l6 and row lines L1—L12 shown as in FIG. 2A indicate series connection each of a key switch (SW) and a forward diode D, the key switch and the diode pair being connected between corresponding column line and row line.

The construction of the timing signal generator 3 will now be described.

The generator 3 comprises a 4-bit/12-step (duodecimal) counter 15 (the counts of this counter are [0000]-[1011], its decimal expressions are [0]-[11] respectively representing notes C-B in the following driven by a clock pulse $\phi$ generated by the clock pulse source not shown which is constantly produced at a predetermined period, a 3-bit/6-step (senary) counter 16 (the counts of this counter are [000]—[101], its decimal expressions are [0]-[5]; respectively representing first to 6th octaves in the following which is driven by the output signal N4 of the most significant bit (fourth bit) of the 12-step counter 15, and an AND gate circuit 17 connected to directly receive the output signals N1, N2 and N4 of the first, second and fourth bits of the 12-step counter 15, and the output signals B1 and B3 of the first and third bits of the 6-step counter 16 and to receive, respectively via inverters 60 and 61, the output signal N3 of the third bit of the 12-step counter 15 and the output signal B2 of the second bit of the 6-step counter 16. The output of AND gate circuit 17 is termed a timing signal SYNC and determines one scanning period to be described later. The first to fourth bit output signals N1—N4 of the 12-step counter 15 are applied to a decoder 12 in the key switch scanning circuit 2. More particularly, signals N1—N4 representing the counts of the counter 15 are decoded by the decoder 12 to produce a "1" signal on either one of twelve output terminals connected to the decoder 12. For example, where the count of the 12-step counter 15 is 7 (in decimal notation) corresponding to note G, only the output terminal O8 of the decoder 12 produces signal "1". The output signals B1, B2, B3 of the first to third bits of the 6-step counter 16 are applied to the other decoder 11 in the key switch scanning circuit 2. More particularly, signals B1, B2, B3 representing the counts of the counter 16 are decoded by decoder 11, and the output signal thereof is applied to either one of column lines l1—l6 of the key switch circuit 1 as a "1" signal. For example, where the count of the counter 16 is 2 (in decimal notation) representing the third octave, the "1" signal is produced on only the column line l3 for scanning respective keys C4, C#4, . . . B4 of the third octave. The output signals of the row lines of the switching circuit 1 are applied to the first input terminals of corresponding AND gate circuits $13_1$—$13_{12}$ respectively of the key switch sanning circuit 2. The second input terminals of the AND gate circuit $13_1$—$13_{12}$ are connected to respectively receive the output signals on the output terminals O1—O12 of the decoder 12. The output signals of the AND gate circuits $13_1$—$13_{12}$ are applied to the multiplier 5 through an OR gate circuit 14 to act as a time division multiplex signal TDM.

Since the timing signal generator 3 and the key switch scanning circuit 2 are constructed as above described, both counters 15 and 16 constitute a 72-step counter and the output signals N1—N4 and B1, B2, B3 (representing counts 0—71) of the 72-step counter determines on scanning period (FIG. 3) of the key switch circuit 1 comprising 61 key switches.

Figure 3:
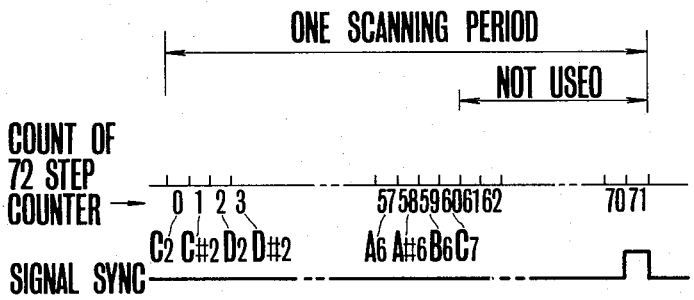
FIG. 3 is a time chart showing the correspondence between one scanning period and the respective notes of the instrument shown in FIGS. 1 and 2.

FIG. 3 shows the correspondence between the counts 0—71 (respective bit times) of the 72 step counter and the type of the keys scanned in one scanning period comprising 72 bits. Since the keys utilized in this embodiment is 61 during the period in which the counts of the 72 step counter are 61—71, no key switch scanning performed. As above described the decoder 12 supplied with the bit output signals N1—N4 of the 12 step counter 15 sequentially produces output signal "1" on its output terminals O1—O12 when the counts of the 12-bit counter 15 are 0—11 as above described. For this reason, when the count of the 12-bit counter 15 is 0 for example, corresponding AND gate circuit $13_1$ is enabled so that when keys C2, C3, . . . C7 corresponding to the note C in any one octave are depressed, the AND gate circuit $13_1$ produces a depressed key signal which is produced as the time division multiplex signal TDM via the OR gate circuit 14. In this manner, when a scanning period is started, the depression states of 61 keys C2, C#2, . . . B6, C7 are sequencially scanned, starting from the keys of the first octave, as the counts of the 72-step counter constituted by the 12-step counter 15 and 6-step counter 16 vary sequentially from 0 to 71. AND gate circuit 17 produces the signal SYNC when one scanning period is over, that is only when the count of the 72-step counter is 71. This SYNC signal is applied to the accumulator 6 and to the latch circuit 7 as will be described later.

The first to fourth bit output signals N1—N4 of the 12-step counter 15 of the timing signal generating circuit 3 and the first to third bit output signals B1, B2, B3 of the 6-step counter 16 are applied to a frequency number memory device 18 to act as address designation signals. Consequently, the frequency number memory device 18 is addressed in synchronism with the scanning of respective key switches of the key switch circuit 1 whereby the frequency number memory device 18 produces a value R (hereinafter termed a frequency number) proportional to the frequency corresponding to the tone pitch of the key now being scanned, and the frequency number R (a data consisting of 17 bits) is applied to the first input terminal A of an adder 19 having a second input terminal B connected to receive the output data (20 bits) of a shift register 20 to be described later. Thus, the adder 19 adds together the frequency number R and the output of the shift register 20 and its sum is applied to the shift register 20 as 20-bit parallel data. The shift register 20 has a capacity of 72 stages each having 20 bits and is driven by the clock pulse $\phi$ to sequentially shift the sum produced by the adder 19. The data of upper 8 bits among the output data (the output of the 72th stage) of the shift register 20 are applied to a sine table 21 to act as an address signal. The reason why only part of the data is used here is because resolution (fineness) need not be very good. The 8-bit data has a content corresponding to the tone pitch of the key which is now being scanned at that time and the sine table 21 produces a data having 12 bits which represent the amplitude values of a sine wave and applied to the multiplier 5. At the same time, the multiplier 5 is supplied with the data of the key now being scanned, that is said time division multiplex signal TDM which is "1" when the key is depressed but "0" when the key is not depressed. Consequently, a waveform (a sine wave signal) having a period corresponding to the tone pitch of the scanned key is produced on the time division basis from the sine table within one scanning period and this output data of the sine table 21 and the time division multiplex signal TDM are multiplied each other by the multiplier 5.

The product (12-bit data) is applied to first input terminal A of an adder 23 in the accumulator 6. The output data of a register 24 (each stage having 15 bits) is applied to a second input terminal B of the adder 23 via a gate circuit 22. The adder 23 adds together both input data to apply the sum to the register 24 as 15-bit parallel data. The register 24 is driven by the aforementioned clock pulse $\phi$ and the data written therein is applied to the gate circuit and the latch circuit 7 as 15-bit parallel data. A control signal $\overline{\text{SYNC}}$ obtained by inverting signal SYNC by an inverter 25 is applied to the gate circuit 22 so as to normally open the same except the end of one scanning period that is at the time when the signal SYNC is produced. The latch circuit 7 is supplied with the signal SYNC acting as a data write signal. Consequently, the adder 23 in the accumulator 6 sequentially adds the product produced by the multiplier 5 starting from the time of staring one scanning period and when the count of the 72-step counter reaches 70, the adder performs the last addition operation. When the count of 72-step counter reaches 71, the signal SYNC is produced so that the latch circuit 7 latches the last accumulated value of the adder 23 which is stored in the shift register 24. As has already been described with reference to FIG. 1, the latched data is sent to the loudspeaker 10 via D/A converter 8 and amplifier 9.

Figure 4:
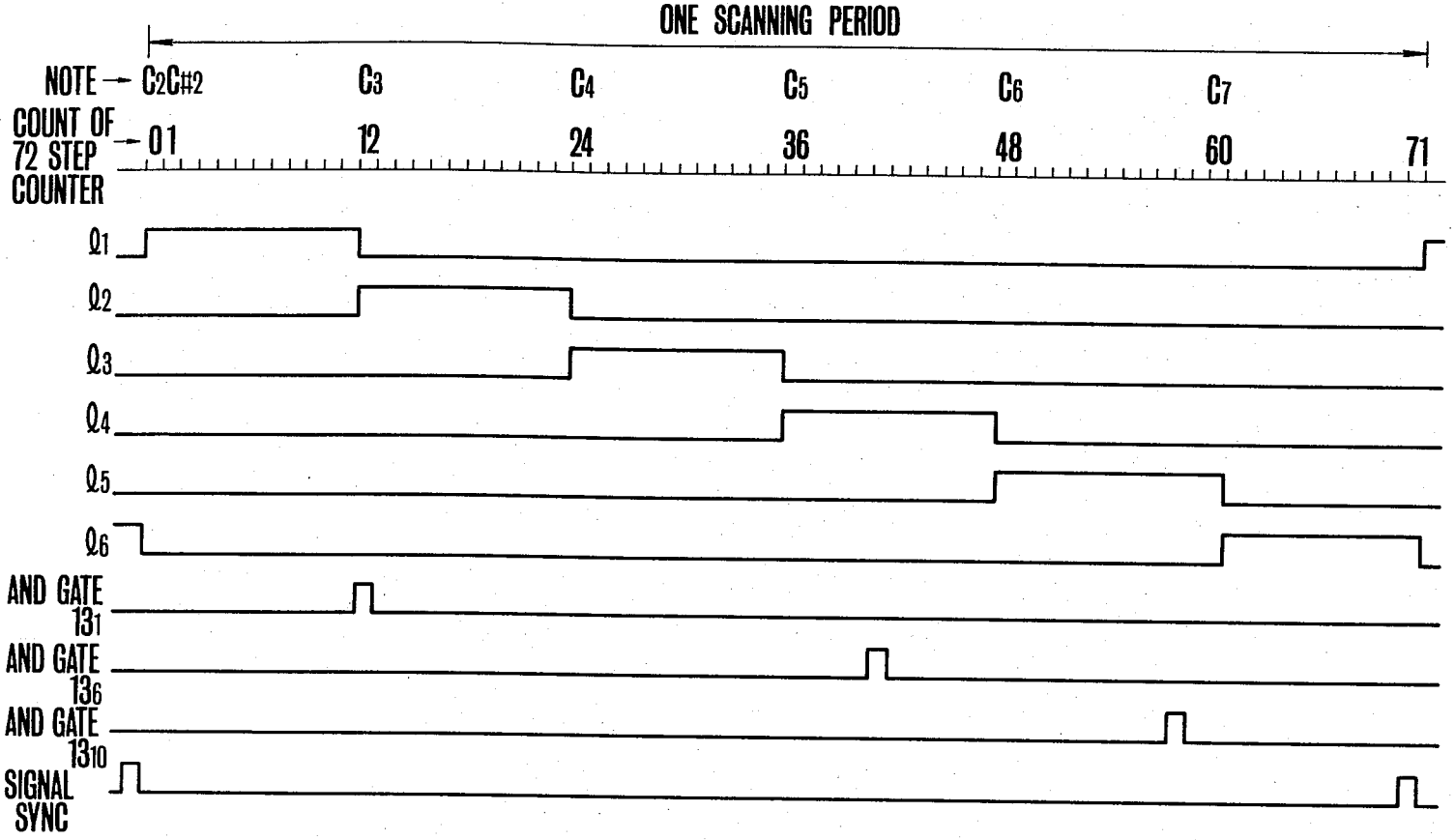
FIG. 4 is a time chart of the waveforms of the respective circuit portions for explaining the operation of the instrument in FIGS. 1 and 2.

The operation of the electronic musical instrument constructed as above described will now be described with reference to the waveforms shown in FIG. 4. Assume now that keys C3, F5 and A6 are simultaneously depressed during a scanning period. By the operation of the 12-step counter 15 and the 6-step counter 16 of the timing signal generator 3 the operation of one scanning period is started when the count of the 72 step counter comprised by these counters 15 and 16. During an interval in which the count of the 72 step counter is 0—11 (that is when the count of the 6-step counter 16 is zero) the output signal "1" of the decoder 11 of the key switch scanning circuit 2 is produced on only the column line l1 of the key switch circuit 1 thus scanning the key switches of keys C2—B2 of the first octave. During this interval decoder 12 sequential produces signal "1" on output terminals 01 to 012 as the count of the 12-step counter 15 sequentially varies from 0 to 11 thus sequentially enabling corresponding AND gate circuit $\mathbf{13}_1$—$\mathbf{13}_{12}$. In this example, since keys C2—B2 of the first octave are not depressed, the time devision multiplex signal TDM is not produced during this priod, that is it is held at "0" state. At the same time, the addresses corresponding to respective keys C2—B2 of the frequency number memory device 18 of the time division waveform generating circuit 4 are sequentially designated by the output signals N1—N4 and B1, B2, B3 of the 72-step counter with the result that the frequency number R corresponding to the tone pitches of the keys C2—B2 is sequentially produced and applied to the adder 19. The adder 19 adds the output data of the shift register 20 and the frequency number R so as to repeatedly apply the sum to the shift resister 20. The data of upper eight bits of the output data of the shift register 20 are applied to the sine table 21 so that during this period it sequentially produces the sine wave value corresponding to keys C2—B2 on the time division basis which is applied to the multiplier 5. During this period however, since the time division multiplex signals of keys C2—B2 are "0", the product during this period is always zero. Although the gate circuit 22 in the accumulator 6 is opened since signal $\overline{\text{SYNC}}$ is "1", the count of the shift register 24 which stores the result of addition of the adder 23 is maintained at zero because the sum of the multiplier 5 is always zero during an interval between the start of one scanning period to an instant of scanning the key B2.

When the count of the 12-step counter 15 returns to 0 from 11 and at the same time when the count of the 6-step counter 16 becomes 1 (that is when the count of the 72-step counter becomes 12), signal "1" is produced on the column line l2 of the key switch circuit 1, thus scanning the key C3 of the second octave. At this time, since the output of the AND gate circuit $\mathbf{13}_1$ is "1" (signal "1" is produced on the output terminal O1 of the decoder 12), the signal TDM becomes "1" which is applied to the multiplier 5. At this time, since the sine wave amplitude value corresponding to key C3 is supplied to the multiplier 5 the multiplier multiplies the sine wave amplitude value with "1". Thus, the product equal to the amplitude value is applied to the adder 23. The adder 23 adds together the accumulated value 0 up to this time and the sine wave value corresponding to key C3 and the sum, that is the sine wave amplitude value to the register 24. During an interval in which the count of the 6-step counter 16 (that is the interval in which the input signal to the column line l2 is "1"), the key switches of the remaining keys C#3—B3 of the second octave are sequentially scanned in the same manner. However, since these keys are not depressed, the signal TDM remains "0" during this interval. For this reason, the sine table 21 produces the sine wave values corresponding to keys C#3—B3 which are applied to the multiplier 30. However, since the product thereof is 0, during this period, the adder 23 repeats the operation of adding the sine wave amplitude value corresponding to the key C3 to 0. Accordingly, the count of the register 24 at the end of the scanning the key B3 is equal to the sine wave amplitude value corresponding to key C3.

When the count of the 12 step counter 15 returns again to zero, and the count of the 6 step counter 16 returns to so that the input signal on the column line l3 of the key switch 1 becomes "1". The scanning of the keys C4 of the third octave is started and the remaining keys C#1—B4 of the third octave would sequentially scanned until the count of the 12 step counter 15 becomes 11. Since all of these keys C4—B4 are not depressed, respective circuit elements function in the same manner as in the scanning of respective keys of the first octave. Thus, the count of the register 24 at the end of scanning of respective keys of the third octave that is the count remains at the sine wave amplitude value corresponding to key C3.

Similarly, when the count of the 6-step counter 16 becomes 3, the input signal to column line l4 of the key switch circuit 1 becomes "1" thereby scanning respective keys C5—B5 of the forth octave. At this time, key F5 is depressed, as the key F5 is scanned, the multiplier 5 multiplies the sine wave sample value corresponding to this key F5 with signal TDM ("1" signal) for applying their product the sine wave sample value corresponding to the key F5 to the adder 23. As a result, the adder adds the sine wave sample value corresponding to the key C3 to the sample value correspnding to the key F5 for applying the sum to register 24. Consequently, the count of the register becomes equal to the sum of the sine wave sample values respectively corresponding to keys C3 and F5, and this count does not vary until the key A6 is scanned.

Just in the same manner, the keys C6—B6 of the fifth octave are scanned and the multiplier 6 produces a sine wave amplitude value corresponding to key A6. Consequently, the count of the counter 24 becomes equal to the sum of the sine wave amplitude values respectively corresponding to keys C3, F5 and A6.

When the count of the 72-step counter becomes 60, the last key C7 is scanned. At this time, since this key is not depressed the count of the register 24 does not vary.

While the count of the 72-step counter reaches 61 and then sequentially vary till 70, since no key is scanned, the count of the register 24 does not vary and the previous count is held by a circulating circuit comprising the gate circuit 22→adder 23→register 24→gate circuit 22. When the count of the 72-step counter becomes 71, that is when the output signal N1, N2 and N4 of the first, third and fourth bits of the 12 step counter 15 and the output signals B1 and B3 of the first and third bits of the 6 step counter 16 are "1", and when the output signal N3 of the third bit of the 12 step counter 15 and the output signal B2 of the second bit of the 6-step counter 16 are "9", the AND gate circuit 17 produces a signal SYNC="1". Then the output of the inverter 25 becomes "0" so that the gate circuit 22 is opened to interrupt said circulating circuit. At the same time, the signal SYNC is applied to the latch circuit 7 so that the sum of the sine wave amplitude values respectively corresponding to keys C3, F5 and A6 are applied to and latched by the latch circuit 7. Consequently, the loudspeaker 10 produces a musical tone corresponding to the resultant of the signals which are produced when the keys C3, F5 and F6 are depressed at the same time. After scanning period is completed, the scanning period is commenced to repeat similar operation.

As above described the invention is advantageous in that it is possible to simulataneously produce a plurality of musical tones corresponding to a plurality of keys which are depressed concurrently with an extremely simple construction. In the foregoing embodiment, the multiplier 5 may be substituted by a gate circuit opened and closed by the time division multiplex signal TDM that is opened when signal TDM is at a "1" level whereas closed when signal TDM is at a "0" level.

Figures 5, 6A, 6B, 6C:
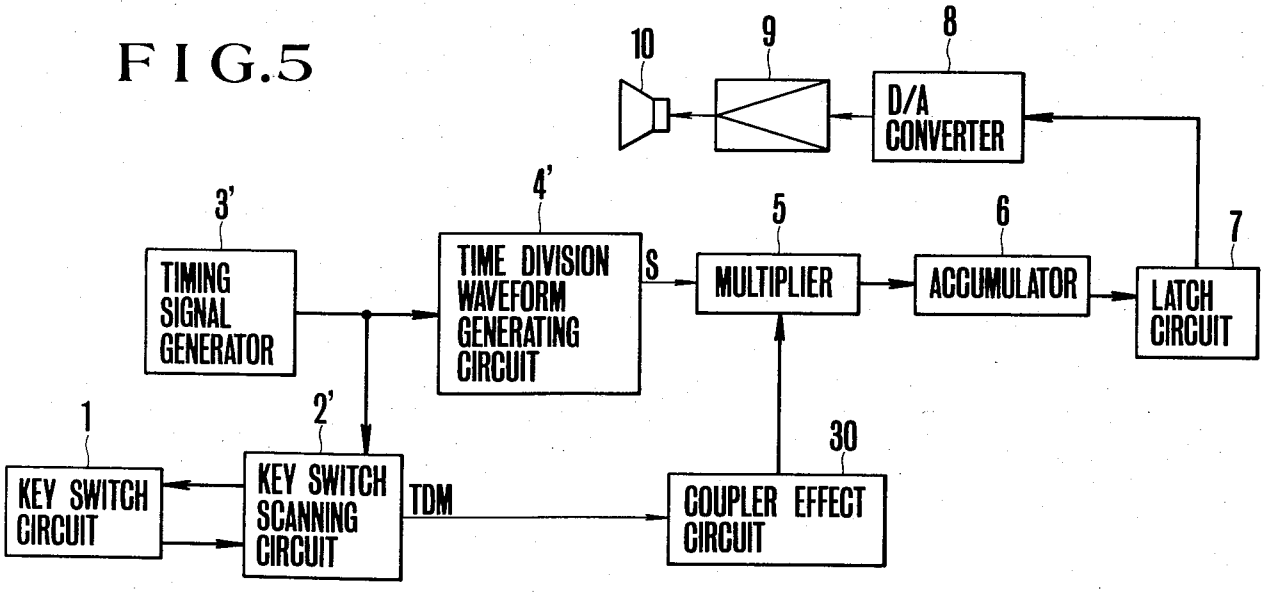
FIG. 5 is a basic block diagram showing another embodiment of the electronic musical instrument according to this invention.
FIGS. 6A and 6B, when combined as shown in FIG. 6C, are a block diagram showing the essential part of FIG. 5 embodied.

One embodiment of the electronic musical instrument according to the second invention will now be described with reference to FIGS. 5 through 8. As shown in FIG. 5, in this electronic musical instrument, a coupler effect circuit 30 is added to the electronic musical instrument described above (FIGS. 2A, 2B and 2C). The coupler effect circuit 30 delays a predetermined time the time division multiplex signal TDM produced by the key switch scanning circuit 2 and then subjects the delayed signal to a predetermined processing. The processed signal is applied to the multiplier 5 to be multiplied with the output signal of the time division waveform generating circuit 4. Although the circuit elements other than the coupler effect circuit 30 have substantially the same construction as those of the above described electronic musical instrument, portions of the key switch scanning circuit 2', the timing signal generating circuit 3' and the time division multiplexed tone waveform generating circuit 4' have different constructions. More particularly, as shown in FIGS. 6A, 6B and 6C, in the coupler effect circuit 30 is provided a shift registers 31—38 driven by the clock pulse $\phi$ and providing a total capacity of 48 stages. Since the time division multiplex signal TDM is applied to and delayed by these shift registers, one scanning period of this electronic musical instrument comprises 120 bit times. In this case too, the number of keys is 61 which is the same as that of the aforementioned electronic musical instrument. Consequently, the scanning period of all of the 61 keys extends between the start of one scanning period (1 bit time) and the 61th bit time in the same manner as in the aforementioned electronic musical instrument.

For the reason described above, there are provided a 12-digit counter 15 and a 4-bit/10-step counter 16' in the timing signal generator 3', thereby providing one scanning period consisting of 120 bit times. For the purpose of producing signal SYNC at the end of one scanning period, that is at the 120th bit time, there is provided an AND gate circuit 17' connected to receive directly the output signals N1, N2 and N4 of the first, second and fourth bits of the 12-step counter 15 and the output signals B1 and B4 of the first and fourth bits of the 10-step counter 16' and to receive, respectively via inverters 65, 66 and 67, the output signal N3 of the third bit of the 12-step counter 15 and the output signals B2 and B3 of the second and third bits of the 10-step counter 16'.

In the key switch scanning circuit 2', decoder 11' corresponds to the decoder 11 (FIG. 2A) of the aforementioned electronic musical instrument. More particularly, in the timing signal generating circuit 3', since the 10-step counter 16' is substituted for the 6-step counter 16 (FIG. 2A), the decoder 11' is constructed to decode the four bit output signal of the 10-step counter 16'.

Also for the reason described above a shift register 20' in the time division multiplexed tone waveform generating circuit 4 comprises 120 stages (1 stage = 20 bits) formed by serially connecting a number of 20 bit registers to have 120 stages. The frequency number memory device 18 also stores the twelve notes of the keys C1—B1 and frequency numbers R corresponding to keys C#7—C10 (36 note). More particularly, since the time division multiplex signal TDM produced by the key switch scanning circuit 2' are applied to the shift registers 31—38 (having a total of 48 stages) of the coupler effect circuit 30, it is necessary to apply a corresponding frequency number R also to the delayed time division multiplex signal TDM for generating a corresponding waveform. The other constructions are the same as in the first embodiment.

Figure 6A:
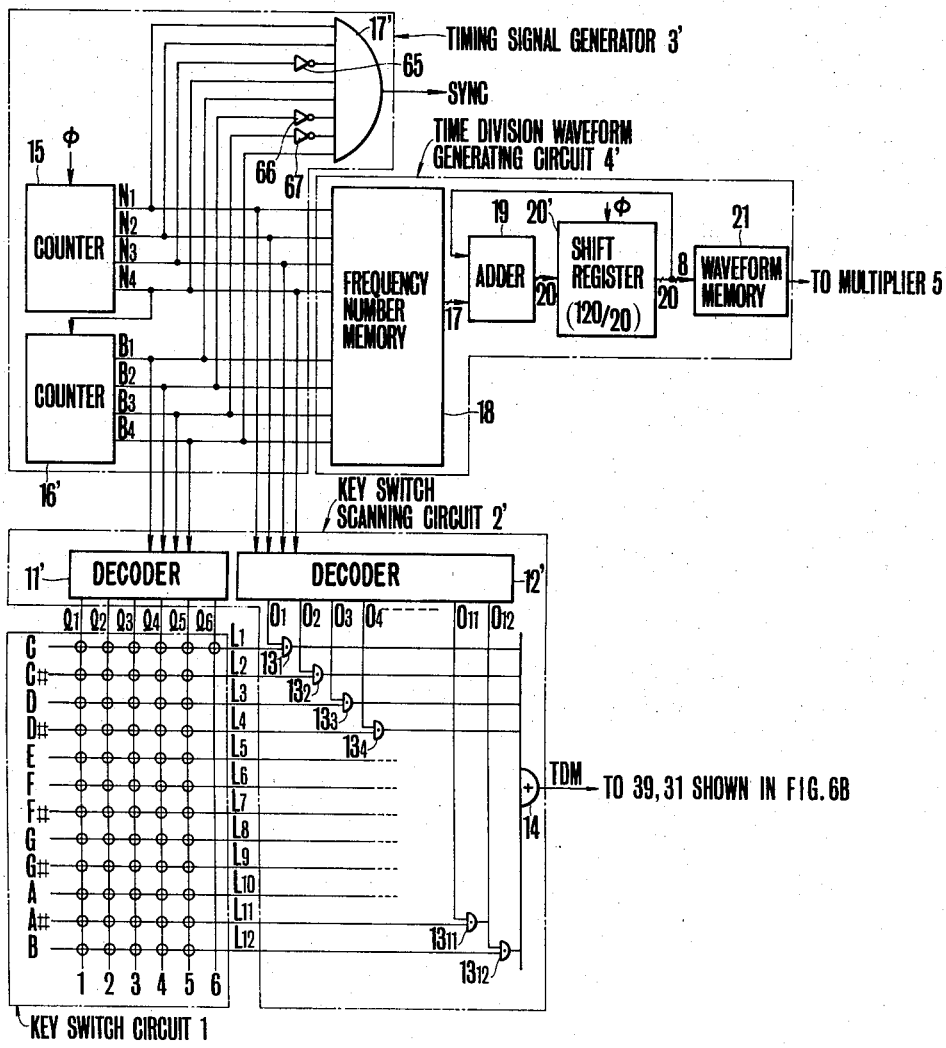
Figure 6B:
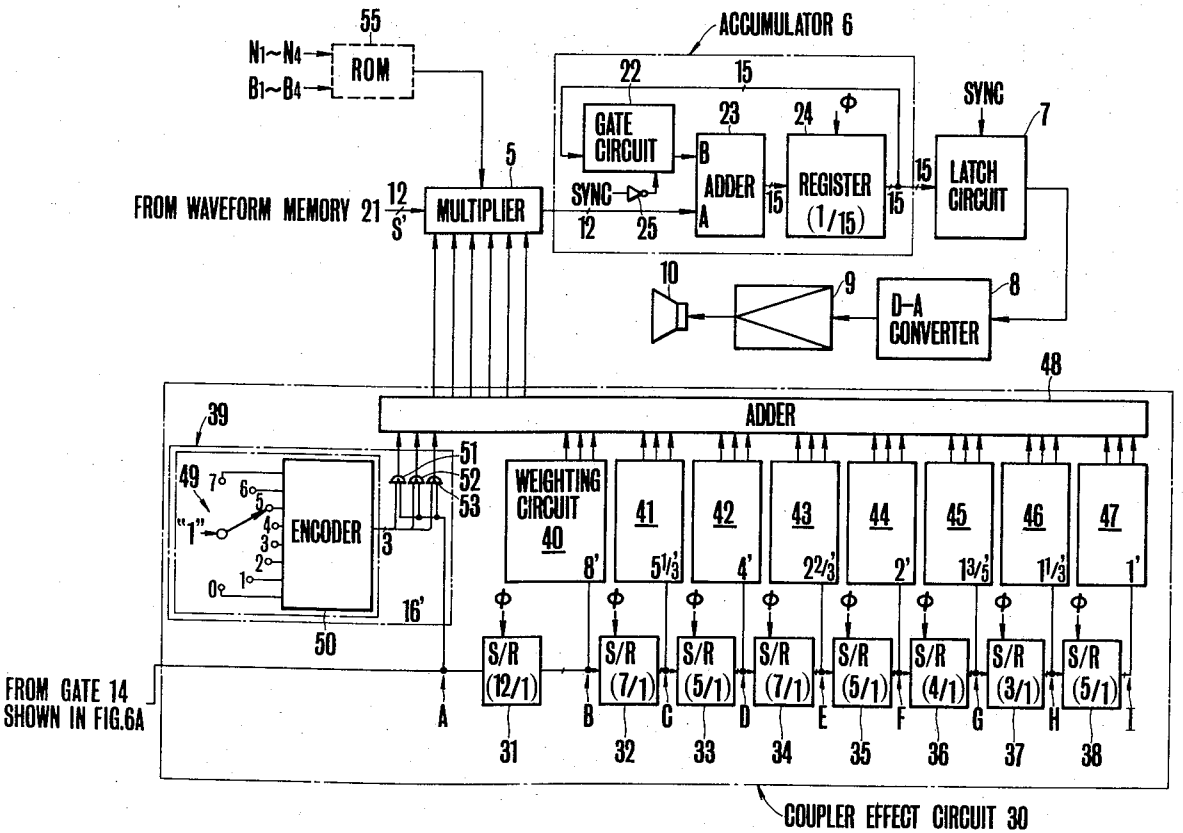

The coupler effect circuit 30 comprises 8 serially connected shift registers 31—38, nine footage weighting circuits 39—47 respectively connected to these shift registers 31—38, and an adder 48 which adds together all of the output signals of the footage weighting circuits 39—47. Shift registers 31, 32, 33, 34, 35, 36, 37 and 38 have capacities of 12-stages/1-bit, 7-stages/1-bit, 5-stages/1-bit, 7-stages/1-bit, 5-stages/1-bit, 4-stages/1-bit, 3-stages/1-bit, and 5-stages/1-bit respectively and are respectively driven by the clock pulse $\phi$ so as to sequentially shift the time division multiplex signal TDM applied to the first shift register 31 toward the shift stages on the later stages. Accordingly, the time division multiplex signal TDM applied to the first stage of the shift register 31 at a certain time is produced from the 12th stage of the shift register 31 after 12 bit times and supplied to the first stage of the shift register 32 of the succeeding stage. Furthermore, the signal TDM supplied to the shift register 32 is produced by the 7th stage thereof after 7 bit times and applied to the first stage of the shift register 33 of the next stage. After being applied to the coupler effect circuit 30 the signal TDM is sequentially delayed by the shift registers 31—38, more particularly by 12 bit times, 7 bit times, 5 bit times, 7 bit times, 5 bit times, 5 bit times, 3 bit times and 5 bit times respectively and produced by respective shift registers 31—38. The input terminal of the shift register 31 is designated as point A, and the output terminals of shift registers 31—38 are respectively designated as points B, C, D, E, F, G, H and I. To point A is connected a 16-foot register weighting circuit 39 (hereinafter "foot" is shown by a prime, that is 16-foot is designated as 16'). In the same manner to points C, D, E, F, G, H and I are connected $5\frac{1}{3}'$, 4', $2\frac{2}{3}'$, 2', 1 3/5 , $1\frac{1}{3}'$ and 1' register weighting circuits 41, 42, 43, 44, 45, 46 and 47. These weighting circuits 39—47 have the same construction. That is each comprising a slide type transfer switch 49, an encoder 50 and three AND gate circuits 51, 52 and 53. In FIG. 6 the construction of only the 16' weighting circuit 39 is shown in detail, and the detail of the other weighting circuits 40—47 is not shown. In the 16' weighting circuit 39, signal "1" is applied to the movable contact of the transfer switch 49 and the signals produced by the stationary contacts 0—7 are applied to an encoder 50. The encoder 50 converts an output signal corresponding to each stationar contanct into a 3-bit data which is applied to first inputs of AND gate circuits 51, 52 and 53. The second inputs of AND gate circuits 51, 52 and 53 are connected to point A, and the output of these AND gate circuits are applied to an adder 48 to act as a 3-bit data. Thus, when the transfer switch 49 engages stationary contact 5, for example, the encoder 50 produces a 3-bit data "101" representing a numerical data 5 thereby applying signal "1" to the first input terminals of the AND gate circuits 51 and 53 and signal "0" to the first input terminal of the AND gate circuit 52. As a consequence, only the AND gate circuits 51 and 53 are enabled so that when the time division multiplex signal TDM which is applied to point A at this time is "1", the date representing numerical value [5] is applied to the adder 48 from the 16' weighting circuit 39.

Figure 7:
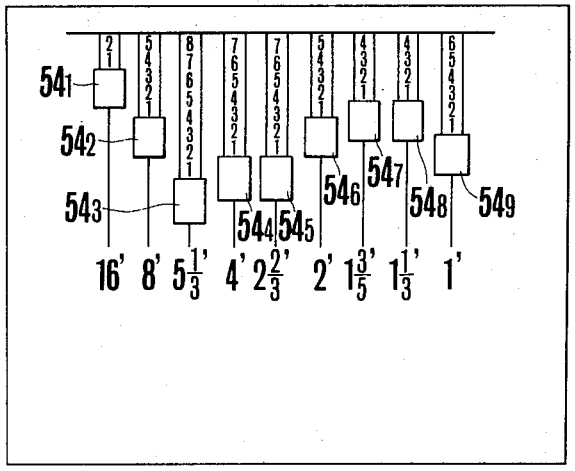
FIG. 7 is a plan view showing a manner of setting the drawbars used in the instrument in FIG. 5.

Drawbars (knobs) which drive the transfer switches of respective weighting circuits 39—47 are arranged as shown in FIG. 7 and disposed near the keyboard of the electronic musical instrument (for example on a panel above the keyboard). As shown, the drawbars $54_1$—$54_9$ are arranged starting from the lefthand side to correspond to respective weighting circuits 39-47. When the drawbars $54_1$—$54_9$ are moved in the longitudinal (back and forth) direction as viewed in FIG. 7, numerals 1—8 come to appear at visible positions. The numerals at the furthest positions respectively remote from the drawbar knobs $54_1$—$54_9$ represent the stationary contacts of the transfer switches to be connected by given drawbars. In FIG. 7 the transfer switch 49 of the 16' weighting circuit 39, for example, is set to the stationary contacts [2]. In this manner, when the player switching selects the positions of the respective drawbars $54_1$—$54_9$, the weights of respective footage register can be set to any desired value. The time division multiplex signal delayed by the shift registers 31—38 are applied with weights corresponding to the set positions of respective drawbars $54_1$—$54_9$ and thereafter supplied to adder 48 from respective footage weighting circuits 39—47. The adder 48 adds together these data to supply its sum to the multiplier 5 in the form of 6-bit data. Consequently, when a key is depressed, the key switch thereof is scanned during one scanning period and when its time division multiplex signal TDM is produced by the key switch scanning circuit 2. This time division multiplex signal TDM is applied to the coupler control circuit 32. The signal is sequentially delayed by respective shift registers 31—38 and then supplied to respective weighting circuits 39—47. More particularly, based on the time division multiplex signal of one key, 9 types of the signals are produced by the weighting circuits 39—47 and supplied to the multiplier 5 through the adder 48 during one scanning period so that a plurality of musical tones (in this example 9) are produced by the depression of one key.

Figure 8:
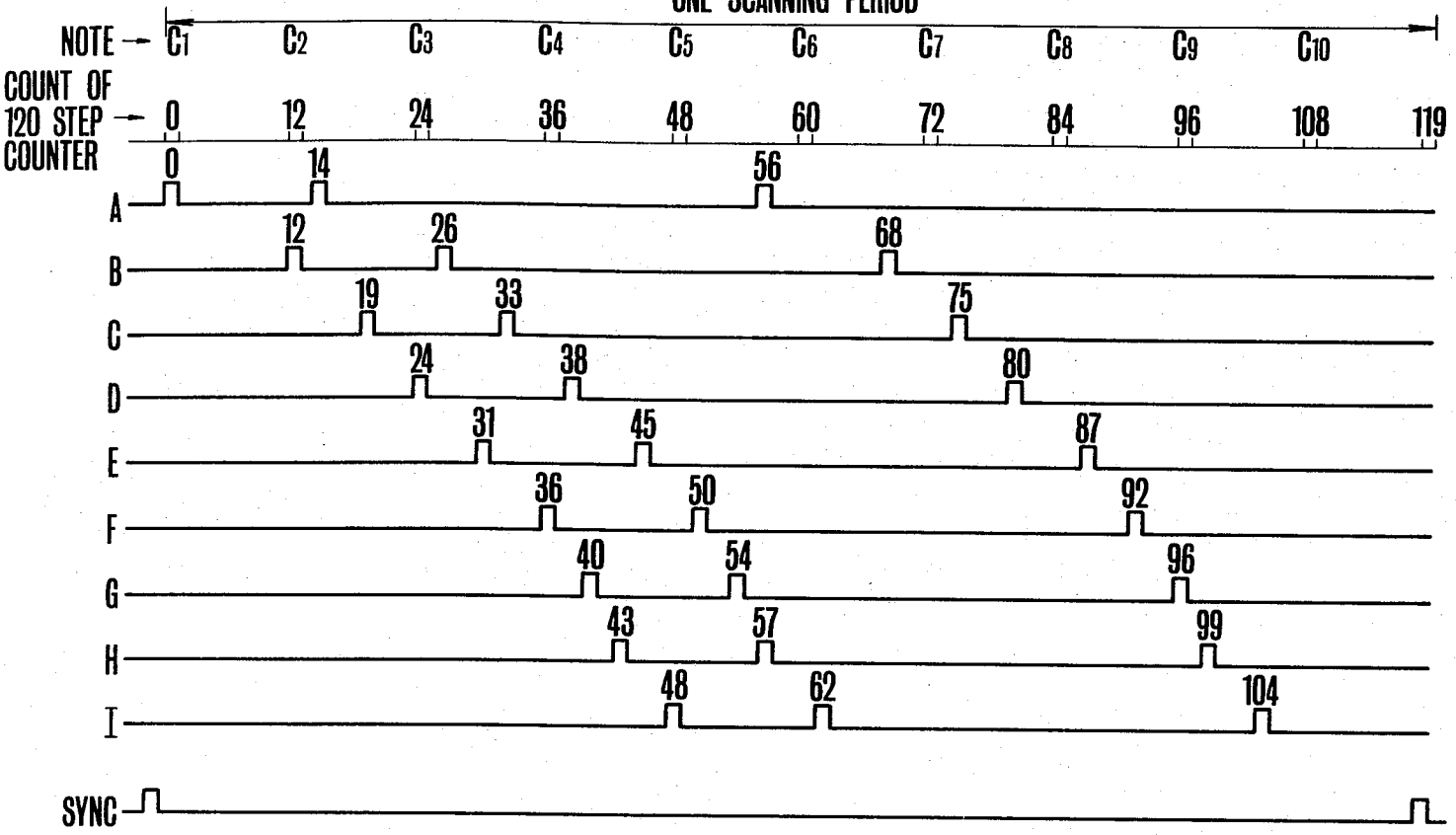
FIG. 8 is a time chart of waveforms for explaining the operations of the respective portions shown in FIGS. 5 and 6.

The operation of the electronic musical instrument described above will be described hereunder with reference to the waveforms shown in FIG. 8. In this example, it is asssumed that keys C2, D3 and G#6 are simultaneously depressed during one scanning period and that the drawbars $54_1$—$54_9$ of the coupler control circuit 30 are set in the state shown in FIG. 7. When the scanning of one scanning period is commenced by the operation of the 12-step counter 15 and the 10-step counter 16' shown in FIG. 6, the key C2 which is depressed at the commencement of the scanning operation would firstly be detected so that the output signal of the AND gate circuit $13_1$ of the key switch scanning circuit 2' becomes "1" with the result that the time division multiplex signal TDM become "1" when the count of the 120-digit counter is 0. This signal TDM ("1") is applied to the shift register 31 and to the AND gate circuits 51—53 of the 16' weighting circuit 39 thereby enabling these AND gate circuits. At this time, since the transfer switch 49 of the 16' weighting circuit 39 is thrown to contact 2 (see FIG. 7), AND gate circuits 51—53 produce data "010" representing a numerical value 2 and the data is applied to adder 48. Assume now that the counts of the shift registers 31 through 38 are all zero before starting one scanning period, at a time when the count of the 120-step counter is zero, the output signals (that is outputs at points B through I of respective shift registers 31—38 are all zero. Consequently, the output of the adder 48 is equal to set value 2 of the drawbar $54_1$ of the 16' weighting circuit 39. On the otherhand, since the sine table 21 produces a sine wave amplitude value corresponding to note C1 the multiplier 5 multiplies the output signal (numerical value 2) of the adder 48 with the sine wave amplitude value of the note C1 and applies the product to accumulator 6. The signal TDM ("1") corresponding to note C1 and applied to shift register 31 is produced at point B after 12-bit times (when the count of the 120-step counter is 12) and then applied to the shift register 32. This signal is sequentially shifted to the shift register 33—38 at later states and produced at points C—I but the counts of the 120-step counter are 19, 24, 31, 36, 40, 43 and 48 respectively (see FIG. 7). In the same manner, keys D3 and G#6 are detected when the counts of the 120-step counter are 14 and 56 respectively, and at this time the time division multiplex ignal TDM becomes "1". The signal TDM ("1") is sequentially shifted by shift registers 31—38. Consequently, signals shown in FIG. 8 is sequentially produced at points A—I during one scanning period. Each time signal "1" is produced at each one of points A—I, the set values of the transfer switch 49 (drawbars $54_1$—$54_9$) in the corresponding weighting circuits 39—47 are applied to the adder 48. At each bit time, the adder 45 adds together the data produced by respective footage weighting circuit 39—47 at that time and applies the sum to the multiplier 5. The multiplier 5 multiplies the output signal of the adder 45 with the sine wave sample value S' produced by the sine table and applies the product to the multiplier 6. The content of the register 24 at a bit time just before the 120-step counter becomes 119, i.e. when it represents count 118, is equal to the sum of the multiplication products of the signals TDM ("1") produced at respective points A—I after starting one scanning period and the values set by drawbars $54_1$—$54_9$ of the corresponding weighting circuit 39—47. At the end of one scanning period, that is at the time when signal SYNC is produced, the sum is latched by the latch circuit 7 and then sent to loudspeaker 10 to sound a musical tone.

As above described, with the electronic musical instrument, when three keys are depressed at the same time, for example, during one scanning period, a total of 24 signals which are delayed by shift registers 31—38 are also produced as musical tones so that it is possible to simultaneously produce synthesized tones of an extremely many musical tones. Moreover, by setting a plurality of drawbars to desired positiones, it is possible to produce any musical tones having tone clors desired by the player.

A modification of the above described electronic musical instrument, that is an electronic musical instrument added with a ROM (read only memory device 55 shown by dotted lines in FIG. 6 will now be described. The ROM 55 stores numerical value data desired for respective bit times during one scanning period, and respective bit signals N1—N4 and B1—B4 of the 120-step counter, that is cascade connected 12-step counter 15 and the 10-step counter 16' are applied to the ROM 55 as the address signals. Accordingly, the numerical data of respective bit times stored in the areas designated by the address signals are sequentially read out from the ROM 55 and applied to the multiplier 5. This multiplier 5 is adapted to make a product that results from multiplying the output of ROM 55 with each output from the time division multiplexed tone waveform generating circuit 4' and the coupler effect circuit 30 in an arbitary order. For example, it may be allowed to multiply the above three output together at once or to make a product between arbitrary two of the three outputs at first and then multiply it with the remainder. Consequently, the sine wave amplitude value read out from the sine table 21 at each bit time is multiplied with the numerical value data read out from the ROM 55 and the product is multiplied with the output signal of the adder 48.

In this case, in addition to the advantages of the electronic musical instrument described above there is also a fixed filter effect caused by the provision of the multiplier 56.

Of course, it is possible to install many types of ROM 54 so as to utilize any one of them at the time of performance.

While in the above description of the embodiments the number of keys was assumed to be 61, this number may be varied as desired. The design of the one scanning period, the key switch scanning circuit, the timing signal generating circuit can be varied depending upon the number of keys. Also a waveform memory device storing a desired musical tone waveform can be substituted for the sine table. Furthermore, any way of providing footage—weighting circuits for the coupler control circuit may be used and the number of drawbars may be increased or decreased as desired.

As can be noted from the foregoing description, according to the first invention of this application there are provided a key switch scanning circuit which sequentially scans a plurality of key switches at a predetermined speed for producing a time division multiplex signal representing the depressed state of respective keys, a time division waveform generating circuit which produces waveforms corresponding to respective keys in synchronism with the scanning of the key switch and on the time division basis, and a multiplier which multiplies the output signal of the time division waveform generating circuit with the time division multiplex signal representing the depressed key state. Consequently, with an extremely simple circuit construction there is an advantage that it is possible to simultaneously generate musical tones corresponding to a number of simultaneously depressed keys. According to the second invention of this application, by merely adding a coupler effect circuit which sequentially delays a predetermined time said time division multiplex signal representing the depressed key state to form a delayed time division multiplex signal it becomes possible to simultaneously generate a plurality of musical tones for one depressed key. Thus, it is possible to obtain a coupler effect by an extremely simple construction. In addition, the player can impart any desired tone color by operating a plurality of drawbars in a coupler effect circuit.

What is claimed is:

1. An electronic musical instrument comprising:

a plurality of key switches;

a key switch scanning circuit for sequentially scanning each of said key switches at a predetermined speed to produce time-division-multiplexed key data signals wherein each individual key has a separate and individual time slot so that the key data signals represent the depressed states of respective keys by the existence of a signal at corresponding time slots;

a time-division-multiplexed tone waveform generating circuit which provides an output signal by generating sequentially all of the tone signals over a plurality of octaves within the range of the musical instrument on a time division basis during each scanning period and in synchronism with the scanning of said key switches, said tone signals representing respectively the frequencies of all of the notes that the musical instrument can generate; and means, responsive to said key data signals, for selectively delivering out the output signal of the time-division-multiplexed tone waveform generating circuit to produce respective musical tone signals in accordance with the depressed states of respective keys when said time-division-multiplexed key data signals arrive.

2. An electronic musical instrument comprising a plurality of key switches, a key switch scanning circuit for sequentially scanning said key switches at a predetermined speed to produce time division multiplexed key data signals representing the depressed states of respective keys by existence of a signal at corresponding time slots, a time division multiplexed tone waveform generating circuit which generates sequentially all of the tone signals within the range of the musical instrument on a time division basis during each scanning period and in synchronism with the scanning of said key switches, said tone signals having respectively the frequencies of all the notes that the musical instrument can generate, and means for delivering out the output signal of the time division multiplexed tone waveform generating circuit to produce the respective musical tone signals in accord with the depressed states of respective keys when said time division multiplex key data signals arrive and further comprising a coupler effect circuit disposed between the time division multiplexed tone waveform generating circuit and said means for delivering.

3. An electronic musical instrument according to claim 2, wherein the coupler effect circuit comprises a delay circuit which delays the time division multiplexed key data signal for a predetermined period of time and a circuit which adds the output from the delay circuit and the time division multiplexed key data signal, and said means delivers out the tone signal corresponding to said time division multiplexed key data signal and the delayed data signal.

4. An electronic musical instrument according to claim 3, wherein the coupler effect circuit further comprises a coupler control circuit which adjusts the respective inputs supplied to the adding circuit.

5. An electronic musical instrument according to claim 2, comprising a plurality of delay circuits which are connected in series and delay the time division multiplexed key data signals for a predetermined period of time and a circuit which adds the outputs from the delay circuits and said time division multiplexed key data signals.

6. An electronic musical instrument according to claim 5, wherein the coupler effect circuit further comprises a coupler control circuit which adjusts the respective inputs supplied to the adding circuit.

7. An electronic musical instrument according to claim 2, wherein said time division multiplexed tone waveform generating circuit includes a constant memory which memorizes a number of constants corresponding to notes and sequentially generates said constants one after another, an accumulator cumulatively adding each of said constants constant by constant, and a waveform memory memorizing sample values of a musical tone and being read out as addressed by the accumulated constants, and wherein said means is a multiplier which multiplies the read out sample values of said waveform memory and said time division multiplexed key data signal.

* * * * *

UNITED STATES PATENT AND TRADEMARK OFFICE

CERTIFICATE OF CORRECTION

PATENT NO. : 4,402,242

DATED : September 6, 1983

INVENTOR(S) : Tetsuo Nishimoto

It is certified that error appears in the above-identified patent and that said Letters Patent is hereby corrected as shown below:

Col. 2, line 8: change "gereratoes" to --generates--

Col. 2, line 28: before "cross" insert --the--

Col. 3, line 41: after"row line" insert --as shown in Fig. 2D.--

Col. 4, line 21: change "sanning" to --scanning--

Col. 4, line 39: change "is" to --are--

Col. 5, line 28: after "is" insert a --,--

Col. 5, line 35: delete "each other"

Col. 5, line 54: change "staring" to --starting--

Col. 6, line 10: change "sequential" to --sequentially--

Col. 6, lines 16-17: change "this priod, that is" to --this period, that is,--

Col. 6, line 27: change "resister" to --register--

Col. 6, line 44: after "is" insert a --,--

Col. 6, line 59: after "value" insert --, is applied--

UNITED STATES PATENT AND TRADEMARK OFFICE

CERTIFICATE OF CORRECTION

PATENT NO. : 4,402,242

DATED : September 6, 1983

INVENTOR(S) : Tetsuo Nishimoto

It is certified that error appears in the above-identified patent and that said Letters Patent is hereby corrected as shown below:

Col. 6, line 60: after "is" insert a --,--

Col. 7, line 12: change "C#1" to --C#4--

Col. 7, line 12: after "would" insert --be--

Col. 7, line 18: change "octave that is" to --octave, that is,--

Col. 7, line 24: change "forth" to --fourth--

Col. 7, line 31: change "correspnding" to --corresponding--

Col. 7, line 33: after "register" insert --24--

Col. 7, lines 51-52: after ",that is" insert a --,--

Col. 8, line 4: change "simulataneously" to --simultaneously--

Col. 9, line 14: change "The coupler effect" to --As shown in Fig. 6B the coupler effect--

Col. 9, line 16: after "to" insert --the input terminals and the output terminals--

Col. 9, line 50: change "comprising" to --comprises--

Col. 9, lines 59-60: change "stationar contanct" to --stationary contact--

Col. 11, lines 5-6: after "(that is" insert a --,-- ; and after"31-38" insert a --)--

UNITED STATES PATENT AND TRADEMARK OFFICE

CERTIFICATE OF CORRECTION

PATENT NO. : 4,402,242

DATED : September 6, 1983

INVENTOR(S) : Tetsuo Nishimoto

It is certified that error appears in the above-identified patent and that said Letters Patent is hereby corrected as shown below:

Col. 11, lines 10, 13, and 14: change "C1" to --C2--

Col. 11, line 26: change"Fig. 8 is" to --Fig. 8 are--

Col. 11, lines 53-54: change "of an extremely" to --of extremely--

Col. 11, line 55: change "positiones" to --positions--

Col. 11, line 56: change "clors" to --colors--

Col. 11, line 59: after "is" insert a --,--

Col. 11, line 61: after "Fig. 6" insert a --)--

Col. 11, line 65: after "is" insert a --,--

Col. 12, lines 18-19: change"multiplier 56." to --multiplier 5.--

Col. 12. lines 20-21: change"ROM 54" to --ROM 55--

Signed and Sealed this

Twenty-ninth Day of May 1984

[SEAL]

Attest:

GERALD J. MOSSINGHOFF

Attesting Officer

Commissioner of Patents and Trademarks